US010928035B2

(12) United States Patent
Kim et al.

(10) Patent No.: US 10,928,035 B2
(45) Date of Patent: Feb. 23, 2021

(54) PHOSPHOR PLATE AND LIGHTING DEVICE INCLUDING THE SAME

(71) Applicant: LG Innotek Co., Ltd., Seoul (KR)

(72) Inventors: Won Jin Kim, Seoul (KR); Ju Yeon Won, Seoul (KR); In Jae Lee, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 352 days.

(21) Appl. No.: 15/629,473

(22) Filed: Jun. 21, 2017

(65) Prior Publication Data

US 2017/0370555 A1 Dec. 28, 2017

(30) Foreign Application Priority Data

Jun. 22, 2016 (KR) ..... 10-2016-0078012

(51) Int. Cl.

| | |
|---|---|
| ***F21V 9/00*** | (2018.01) |
| ***F21S 41/16*** | (2018.01) |
| ***F21V 9/30*** | (2018.01) |
| ***F21S 41/20*** | (2018.01) |
| ***F21S 41/176*** | (2018.01) |
| ***F21V 5/04*** | (2006.01) |

(52) U.S. Cl.

CPC ..... *F21V 9/00* (2013.01); *F21S 41/16* (2018.01); *F21S 41/176* (2018.01); *F21S 41/285* (2018.01); *F21V 5/04* (2013.01); *F21V 9/30* (2018.02); *F21S 41/20* (2018.01)

(58) Field of Classification Search

CPC ..... F21S 41/16; F21S 41/14; F21S 41/285; F21S 41/43; F21V 9/30; F21V 9/00; F21Y 2115/30; F21Y 2115/10; G03B 21/204

USPC ..... 362/84

See application file for complete search history.

(56) References Cited

U.S. PATENT DOCUMENTS 8,454,184 B2 * 6/2013 Choi ..... G02F 1/133617 362/231
8,708,511 B2 4/2014 Kawakami
8,919,976 B2 * 12/2014 Nagasaki ..... F21V 9/00 362/84

(Continued)

FOREIGN PATENT DOCUMENTS

EP 2738888 A2 6/2014
WO WO-2012/128384 A1 9/2012

(Continued)

OTHER PUBLICATIONS

European Search Report dated Dec. 13, 2017 in European Application No. 17177248.6.

*Primary Examiner* — Thien M Le
*Assistant Examiner* — Tae W Kim
(74) *Attorney, Agent, or Firm* — Saliwanchik, Lloyd & Eisenschenk

(57) ABSTRACT

Embodiments of the present invention relate to a phosphor plate and a lighting device including the phosphor plate, the phosphor plate according to an embodiment of the present invention has a light incident region on which light generated from a light source is incident and a light emitting region which converts a wavelength of the incident light and then outputs the light, wherein a ratio of a diameter of the light incident region and a diameter of the light emitting region ranges from 1:3 to 1:9.

18 Claims, 7 Drawing Sheets

(56) References Cited

U.S. PATENT DOCUMENTS

| | | | | |
|---|---|---|---|---|
| 2012/0230007 | A1* | 9/2012 | Kawakami | F21V 9/14 362/19 |
| 2014/0169024 | A1 | 6/2014 | Hager et al. | |
| 2015/0102722 | A1 | 4/2015 | Ohbayashi et al. | |
| 2017/0016586 | A1* | 1/2017 | Tsuda | F21S 41/19 |

FOREIGN PATENT DOCUMENTS

| | | | |
|---|---|---|---|
| WO | WO-2015/170696 | A1 | 11/2015 |
| WO | WO-2017/040433 | A1 | 3/2017 |

* cited by examiner

PHOSPHOR PLATE AND LIGHTING DEVICE INCLUDING THE SAME

CROSS-REFERENCE TO RELATED APPLICATION

This application claims priority under 35 U.S.C. § 119 to Korean Patent Application No. 10-2016-0078012, filed on Jun. 22, 2016, which is herein incorporated by reference in its entirety.

BACKGROUND

Field of the Invention

Embodiments of the present invention are related to a phosphor plate and a lighting device including the same, specifically a lighting device which can be used in a lamp for vehicles.

Discussion of Related Art

A luminous element is an element that converts electricity into light. Main luminous elements include a Light Emitting Diode (LED), a Laser Diode (LD), a laser, and the like.

Recently, as a demand for a high efficiency, low power lighting device has increased, research on a lighting device using a laser, a LD, a high power light emitting diode, and the like as a light source is being conducted. Particularly, in a field of vehicles where energy saving has become an issue, there is an attempt to replace existing light sources used in head lamps with a laser, a LD, or a high power light emitting diode.

Such a laser, a LD, or a high power light emitting diode emits an excitation ray which has a wavelength of 500 mm or less. If the human body is exposed to an excitation ray which has a wavelength of 500 mm or less, the excitation ray may cause harmful effects on the human body such as visual impairment, burns, and the like. Accordingly, a lighting device using a laser, a LD, or a high power light emitting diode as a light source needs to include a conversion device which converts an excitation ray from a phosphor to a visible ray, and a phosphor plate which includes a phosphor may be used as a conversion device. For example, a blue light, which is output from a low-wavelength light source emitted with a spectrum having relatively thin width, may be converted to white light by passing through a phosphor plate which includes a phosphor.

On one hand, a performance of a lighting device may be controlled based on a diameter of a light emitting surface of the lighting device. For example, as a diameter of a light emitting surface of a lighting device becomes smaller, an energy density per area becomes too high and a phosphor plate may be damaged. On the other hand, in order to increase a diameter of a light emitting surface of a lighting device, the lighting device becomes larger, and hence it is difficult to miniaturize the structure of the lighting device.

SUMMARY OF THE INVENTION

Embodiments of the present invention provide a lighting device including a phosphor plate which has a different ratio between a diameter of a light incident region and a diameter of a light emitting region, wherein a lighting device includes the phosphor plate.

A phosphor plate according to an embodiment of the present invention has a light incident region on which light generated from a light source is incident and a light emitting region which converts a wavelength of the incident light and then outputs the light, wherein a ratio of a diameter of the light incident region and a diameter of the light emitting region ranges from 1:3 to 1:9.

A lighting device according to an embodiment of the present invention includes: a light source which generates a laser ray, a light conversion unit which includes a phosphor plate having a light incident region on which the laser ray is incident and a light emitting region which outputs a converted light excited by the laser ray; and a housing which is arranged on a front surface of the light conversion unit and has an opening which exposes the light emitting region of the phosphor plate, wherein a ratio of a diameter of the light incident region of the phosphor plate and a diameter of the light emitting region of the phosphor plate ranges from 1:3 to 1:9.

The lighting device of the invention is rendered to include a phosphor plate which has a different ratio in terms of the diameter of the light incident region and the diameter of the light emitting region, and thereby it is possible to easily adjust a performance of the lighting device by controlling the light emitting region of the lighting device without limiting a distance between the phosphor plate and the light source.

DETAILED DESCRIPTION OF EXEMPLARY EMBODIMENTS

Figure 1:
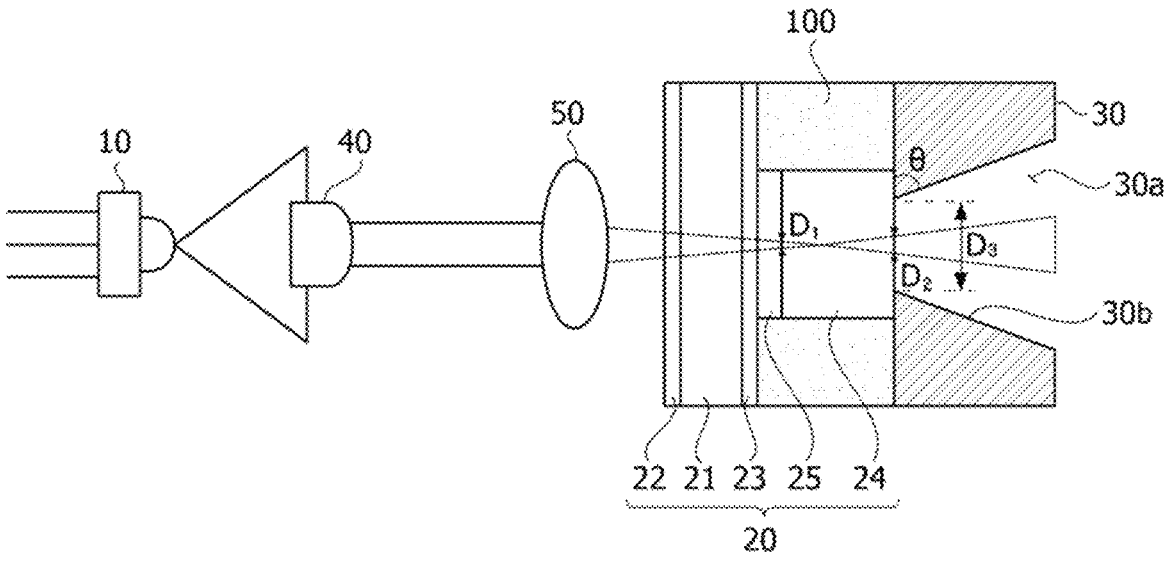
FIG. 1 is a cross sectional view of a lighting device according to an embodiment of the present invention.

While the invention can allow various modifications and alternative embodiments, specific embodiments thereof are shown by way of example in the drawings and will be described hereafter. However, it should be understood that there is no intention to limit the invention to the particular embodiments disclosed, but on the contrary, the invention is to cover all modifications, equivalents, and alternatives falling within the spirit and scope of the invention.

It will be understood that although terms including ordinal numbers such as "first," "second," etc. may be used herein to describe various elements, these elements are not limited by these terms. The terms are used to distinguish one element from another. For example, a second element could be termed a first element without departing from the teachings of the present inventive concept, and similarly a first element could be also termed a second element. The term "and/or" includes any and all combination of one or more of the related listed items.

When an element is referred to as being "connected to" or "coupled with" another element, not only it can be directly connected or coupled to the other element, but also it can be understood that intervening elements may be present. In contrast, when an element is referred to as being "directly connected to" or "directly coupled with" another element, there are no intervening elements present.

The terminology used herein is for the purpose of describing particular embodiments only and is not intended to limit the present inventive concept. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments of the present invention will be described in detail with reference to the accompanying drawings, and regardless of the numbers in the drawings, the same or corresponding elements will be assigned with the same numbers and overlapping descriptions will be omitted.

Hereinafter, a lighting device according to embodiments of the present invention will be explained in detail by referring to accompanied drawings.

FIG. 1 is a cross sectional view of a lighting device according to an embodiment of the present invention.

As shown in FIG. 1, the lighting device according to an embodiment of the present invention comprises: a light source 10; a light conversion unit 20 which is disposed in a direction that light which is output from the light source 10 progresses and converts the output light; and a housing 30 which includes an opening 30*a* formed in a light emitting region of the phosphor plate 24 and adjusts light distribution.

The light source 10 may generate a blue laser ray which has 450 nm band of wavelength. The light generated from the light source 10 progresses to the light conversion unit 20. The light conversion unit 20 is rendered to be disposed in a direction in which the laser ray is released and to include a phosphor plate 24, so as to be able to output white light through the opening 30*a* of the housing by reacting the white light with the laser ray which belongs to a blue wavelength band released from the light source 10.

The light conversion unit 20 may transmit some part of the laser ray which belongs to the blue wavelength band released from the light source 10, and convert the other part of the laser ray so as to form a converted light which belongs to a yellow wavelength band. The light conversion unit 20 may generate white light by combining the laser ray and the converted light, and the white light may be released through the opening 30*a* of the housing 30.

The light conversion unit 20 may include a substrate 21, an antireflection coating 22, a short wavelength filter 23 and a phosphor plate 24.

The substrate 21 may include, but not be limited to, sapphires. The substrate 21 may offer a function of radiation of heat in which heat generated from the light output from the light source passing through the light conversion unit 20 or upon operating the light source 10 is transferred or released. The antireflection coating 22 which is coated onto a back surface of the substrate 21 is for maximizing the amount of the incident light by preventing the light from being reflected from the surface of the substrate 21 when the light output from the light source 10 is incident on the substrate 21.

The short wavelength filter 23 is disposed on the front surface of the substrate 21, and the short wavelength filter 23 is for blocking light which belongs to a particular wavelength band. For instance, the short wavelength filter 23 may block light which has a wavelength above 500 nm. The short wavelength filter 23 may be provided between the substrate 21 and the phosphor plate 24 and may re-reflect light in a direction towards the opening 30*a*, in which the light is a part of the converted light in the phosphor plate 24 and progresses in a direction towards the substrate 21 instead of the opening 30*a*.

Figure 2:
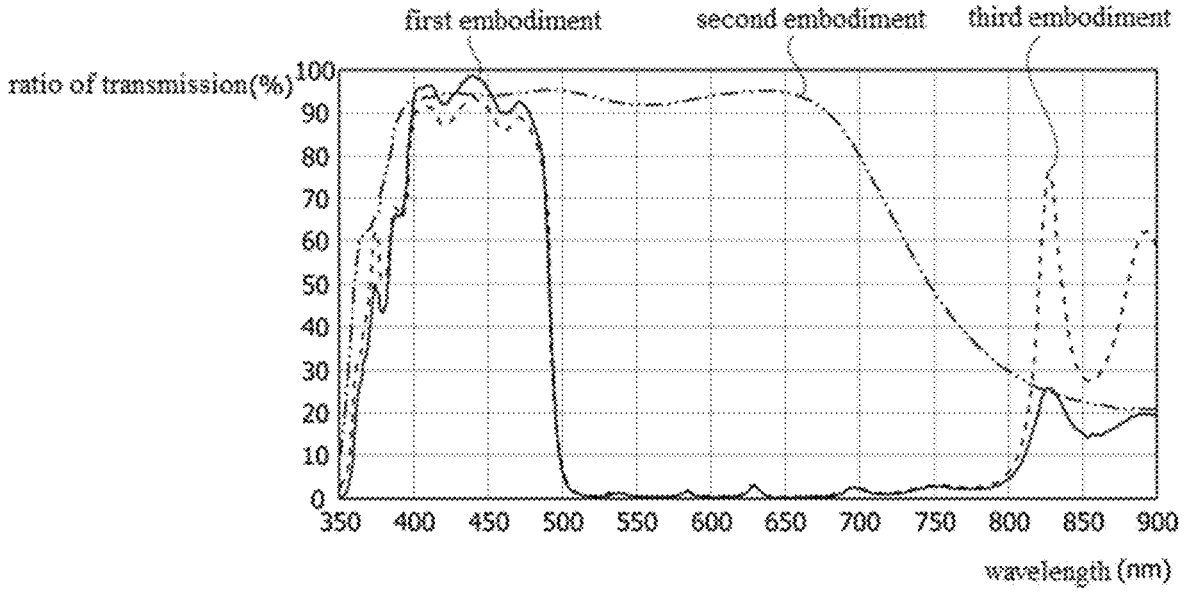
FIG. 2 is a graph showing a function of an antireflection coating and a short wavelength filter.

FIG. 2 is a graph showing the function of antireflection coating and a short wavelength filter.

As shown in FIG. 2, in the case of the first embodiment which includes only the substrate (referred to as 21 in FIG. 1) and the short wavelength filter (referred to as 23 in FIG. 1), a light which has a wavelength band of approximately between 500 nm and 800 nm is blocked, and only light which belongs to the rest of the wavelength band is transmitted. In addition, in the case of the second embodiment which includes only the substrate (referred to as 21 in FIG. 1) and the antireflection coating (referred to as 22 in FIG. 1), all of the light emitted from the light source (referred to as 10 in FIG. 1) is transmitted, and in particularly, light absorption, which is caused by scattering and reflection of the light which belongs to the blue wavelength band (between 350 nm and 500 nm) generated from the light source (referred to as 10 in FIG. 1), may be minimized.

Furthermore, in the case of the third embodiment, which includes all of the substrate (referred to as 21 in FIG. 1), the short wavelength filter (referred to as 23 in FIG. 1), and the antireflection coating (referred to as 22 in FIG. 1), a light which has a wavelength band of approximately between 500 nm and 800 nm is blocked and at the same time a ratio of transmission of the light which belongs to the blue wavelength band may be improved.

Referring to FIG. 1 again, the phosphor plate 24 may be provided on a surface which is in contact with the housing 30, and may convert an absorbed light to a light which has a different wavelength and then may release the light. The phosphor plate 24 converts the incident laser ray to a light which belongs to a yellow wavelength band so as to generate a converted light, and the converted light forms a white light by being combined with the laser ray which passes through the phosphor plate 24. Between the said phosphor plate 24 and the short wavelength filter 23, a bonding layer 25 is further disposed, and thus the bonding layer 25 may enhance adhesion between the short wavelength filter 23 and the phosphor plate 24.

The housing 30 is connected to the light conversion unit 20 at the side of the light emitting region of the phosphor plate 24, and may include the opening 30*a* which exposes the light emitting region of the phosphor plate 24. That is to say, the housing 30 may expose a part of a front surface of the phosphor plate 24. Moreover, the housing 30 may be arranged to cover a part of the front surface of the phosphor plate 24. Accordingly, the light emitted from the light conversion unit 20 may be emitted directly to the outside through the opening 30*a* of the housing, or may be emitted to the outside by being reflected on an inside surface 30*b* of the housing which is inclined so as to have a tilting angle θ of less than 90° with respect to the light emitting region of the phosphor plate 24.

Figure 3:
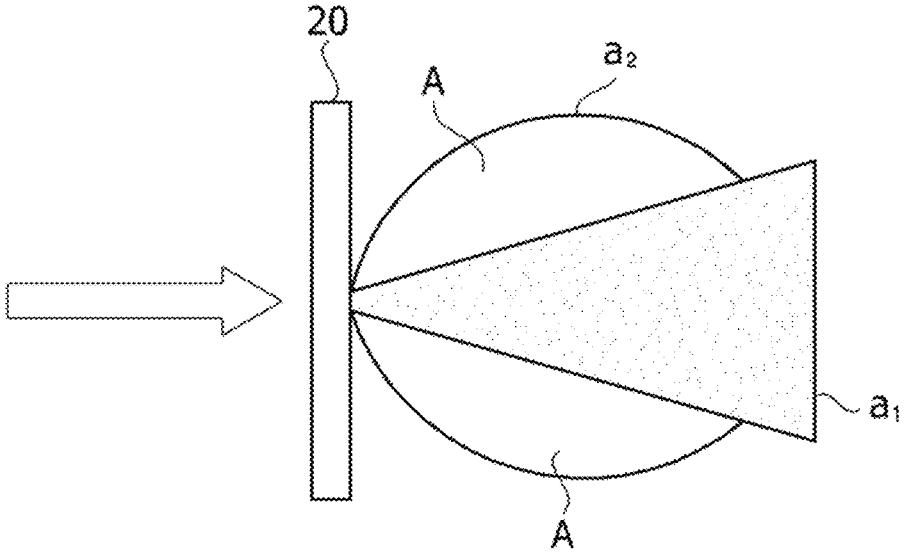
FIG. 3 is a cross sectional view showing light output of a common lighting device.

FIG. 3 is a cross sectional view showing light output of a common lighting device.

As shown in FIG. 3, from among the laser rays released from the light source (referred to as 10 in FIG. 1) and incident on the light conversion unit 20, the laser ray which belongs to the blue wavelength band and is transmitted through the light conversion unit 20 forms an area of light distribution a1 according to Gaussian distribution. Moreover, the converted light which is converted by the phosphor plate (referred to as 24 in FIG. 1) forms an area of light distribution a2 according to Lambertian distribution.

That is, the white light is formed in an area in which the laser ray which belongs to the blue wavelength band according to Gaussian distribution and the yellow light according to Lambertian distribution overlap with each other, however, the light which belongs to the yellow wavelength band is released as is in an area A which is outside of the range of the Gaussian distribution. This light which belongs to the yellow wavelength band increases the overall deviation in colors in the light released from the lighting device and generates yellow-based light in the vicinity of the white light.

Referring to FIG. 1 again, the lighting device according to the embodiment is arranged so as to cover some part of the light conversion unit 20, and the housing 30 overlaps with an area which is not the light emitting region of the phosphor plate 24, and thereby a yellow-based light may be blocked.

The opening 30*a* of the housing 30 may be formed with a structure in which the opening 30*a* is inclined so as to have a tilting angle θ of less than 90° with respect to the light emitting region of the phosphor plate 24. The opening 30*a* of the housing 30 may have a shape in which a diameter increases along the direction of progress of the light passing through the light conversion unit 20. That is, the diameter of the opening 30*a* may increase as the distance from the light conversion unit 20 increases. In this case, the diameter of the opening 30*a* may be the smallest at the portion in contact with the light conversion unit 20. Thus, the portion of the opening 30*a* with the smallest diameter may have the same size as a diameter of the light emitting region of the phosphor plate 24.

When the housing 30 includes a material which has good thermal conductivity such as Al, Cu, and the like for radiating heat, the housing 30 may be a Heat sink. In this case, the white light emitted from the light conversion unit 20 may be reflected on the inside surface 30*b*, and thereby the direction of progress of the white light may be adjusted. On one hand, a metallic material or a reflecting material which can reflect light may be coated only on the inside surface 30*b* of the housing. However, the structure of the housing is not limited thereto.

The tilting angle θ may be set up based on an oriented angle of the white light emitted from the light conversion unit 20.

For example, the oriented angle of the white light emitted from the light conversion unit 20 is in a range of 150° to 170°, the tilting angle θ of the opening 30*a* of the housing 30 may be in a range of 20° to 90°.

If the tilting angle θ of the opening 30*a* of the housing 30 exceeds 90°, the opening 30*a* of the housing 30 may have a shape in which a diameter decreases along the direction of progress of the light passing through the light conversion unit 20. Thus, undesirably, a sufficient amount of the white light cannot be emitted due to the housing 30. In addition, if the tilting angle θ of the opening 30*a* of the housing 30 is less than 20°, the white light emitted from the light conversion unit 20 cannot be reflected on the inside surface 30*b* of the housing 30*a*. Accordingly, the tilting angle θ of the opening 30*a* of the housing 30 may be in a range of 20° to 90°, but the range is not limited thereto.

On one hand, the tilting angle θ of the opening 30*a* of the housing 30 may be set to control a straightness of the white light emitted from the light conversion unit 20.

Figure 4A:
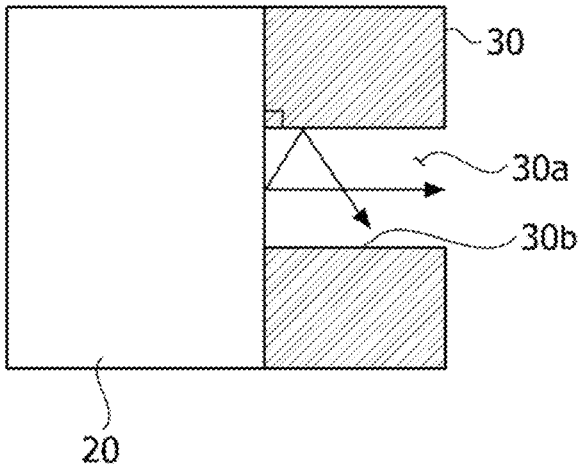
FIG. 4*a* and FIG. 4*b* are cross sectional views showing a direction of progress of a white light based on a tilting angle of an opening of a housing.
Figure 4B:
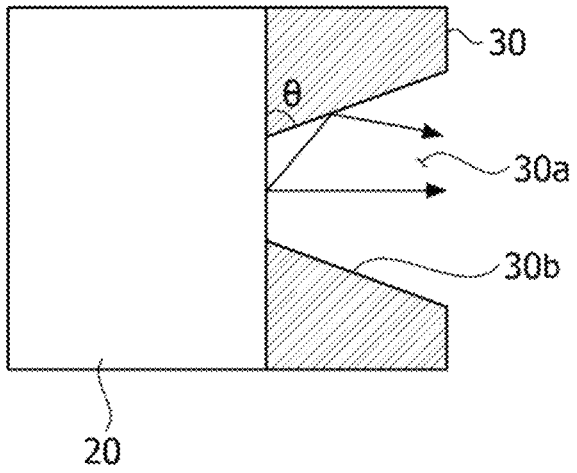

FIG. 4*a* and FIG. 4*b* are cross sectional views showing a direction of progress of a white light according to a tilting angle of an opening of a housing.

As shown in FIG. 4*a*, when the tilting angle θ of the opening 30*a* of the housing 30 is 90°, the white light emitted from the light conversion unit 20 can be reflected on the inside surface 30*b* of the housing 30*a*, and thereby the white light may be dissipated within the opening 30*a* rather than being emitted to the outside. Further, even if the light reflected on the inside surface 30*b* of the housing 30 is emitted to the outside, the light cannot progress straight in a horizontal direction.

As shown in FIG. 4*b*, when the tilting angle θ of the opening 30*a* of the housing 30 is 60°, the white light emitted from the light conversion unit 20 can be reflected on the inside surface 30*b* of the housing 30*a* and the reflected light can have straightness as compared to the case described in FIG. 4*a*. That is to say, when the tilting angle θ of the opening 30*a* of the housing 30 becomes smaller, the degree of straightness of the white light emitted from the opening 30*a* of the housing can be improved.

As described above, however, when the tilting angle θ of the opening 30*a* of the housing 30 is 20° or less, the white light emitted from the light conversion unit 20 cannot be reflected on the inside surface 30*b* of the housing 30*a*.

Accordingly, considering the orientated angle and the straightness of the white light emitted from the light conversion unit 20, the tilting angle θ of the opening 30*a* of the housing 30 may be greater than 20°, and smaller than 90°. More preferably, the tilting angle θ may be in a range of 20° to 60°, but the range is not limited thereto.

However, although not shown in the figures, the front surface of the phosphor plate 24, which is exposed at the opening 30*a* of the housing, may be formed of an uneven structure. In this case, the diffusion and the scattering effect of the light may be improved by the uneven structure.

A molding 100 which includes white silicon may be disposed between the housing 30 and the short wavelength filter 23. The molding 100 may be disposed to surround a side surface of the phosphor plate 24. The molding 100 may be rendered to include an organic material in which a silicon resin and $TiO_2$ are mixed, but the materials are not limited thereto. The molding 100 has reflexibility, thereby reflecting light emitted to the side surface of the phosphor plate 24 and directing the light to the opening 30*a* of the housing 30.

In general, the performance of the lighting device may be controlled based on a diameter of the light which is emitted from the opening 30*a*. For example, as a diameter of a light emitting surface of the lighting device becomes smaller, an energy density per area becomes too high and the phosphor plate 24 may be damaged. On the other hand, in order to increase the diameter of the light emitting surface of the lighting device, the diameter of the light incident region of the light which is incident on the phosphor plate 24 must become larger. That is, because there should be a sufficient distance between the light conversion unit 20 and the light source 10, the lighting device becomes larger, and hence it is difficult to miniaturize the structure of the lighting device.

Therefore, the lighting device according to an embodiment of the present invention can control a ratio (D1:D2) of a diameter D1 of the light incident region of the light which is incident on the phosphor plate 24 and a diameter D2 of the light emitting region of the phosphor plate 24 based on a thickness of the phosphor plate 24. Here, the light incident region and the light emitting region, which face each other, may respectively be disposed on a surface of the phosphor plate 24. That is, the light incident region may be disposed on a first surface (back surface) of the phosphor plate 24, which faces the light source 10. In addition, the light emitting region may be disposed on a second surface (front surface) of the phosphor plate 24, which faces the opening 30*a* at the opposite side of the first surface. Moreover, a diameter D3 of the opening 30*a* of the housing 30 may also become larger as the thickness of the phosphor plate 24 increases.

Figure 5A:
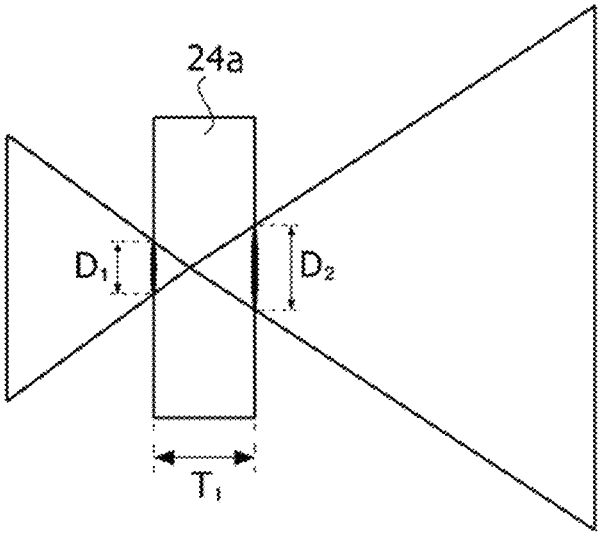
FIG. 5*a* and FIG. 5*b* are cross sectional views showing a diameter of a light incident region of light which is incident on a phosphor plate of the present invention and a diameter of a light emitting region of the phosphor plate.
Figure 5B:
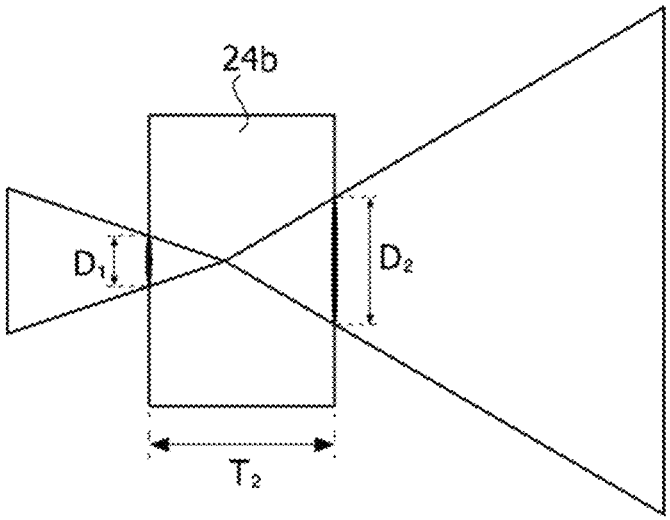

FIG. 5*a* and FIG. 5*b* are cross sectional views showing a diameter of a light incident region of light which is incident on a phosphor plate of the present invention and a diameter of a light emitting region of the phosphor plate.

Even if the diameter D1 of the light incident region of the light which is incident on a first phosphor plate 24*a* having a first thickness T1 as shown in FIG. 5*a* and the diameter D1 of the light incident region of the light which is incident on a second phosphor plate 24*b* having a second thickness T2 which is thicker than the first thickness T1 as shown in FIG. 5*b* are the same, the diameters D2 of the light emitting region of the first phosphor plate 24*a* and the second phosphor plate 24*b* are different from each other. That is because the thicknesses of the first and the second phosphor plates 24*a* and 24*b* are different from each other.

The diameter D1 of the light incident region may be adjusted based on the distance between the first phosphor plate 24*a* and the second phosphor plate 24*b*. In addition, because the diameter D2 of the light emitting region becomes larger as the thicknesses of the first and the second phosphor plate 24*a* and 24*b* increase, the diameter D2 of the light emitting region may be controlled based on the thickness of the phosphor plate 24.

In this case, the first and the second phosphor plates may have the ratio of the diameter of the light incident region and the diameter of the light emitting region which ranges from 1:3 to 1:9.

In particular, the ratio of the diameter of the light incident region and the diameter of the light emitting region of the phosphor plate according to an embodiment of the present invention is shown below in Table 1.

Table 1 provided below shows the ratio of the diameters of the light incident region and the light emitting region based on the thickness of the phosphor plate.

That is, as shown in Table 1 below, when the ratio of the diameter of the light incident region and the diameter of the light emitting region is 1:3 to 1:9, at this time, the thickness of the phosphor plate may be of 60 μm to 160 μm. Here, the thickness may be a distance between the back surface (the first surface) and the front surface (the second surface) of the phosphor plate. In particular, as the thickness of the phosphor plate 24 increases, the diameter of the light emitting region increases with respect to the diameter of the light incident region.

TABLE 1

| Thickness of phosphor plate (μm) | Diameter of light incident region (D1):Diameter of light emitting region (D2) |
|---|---|
| 60~80 | 1:3~1:4.5 |
| 80~100 | 1:4.5~1:5.5 |
| 100~120 | 1:5.5~1:6.5 |
| 120~140 | 1:6.5~1:7.5 |
| 140~160 | 1:7.5~1:9 |

Figure 6A:
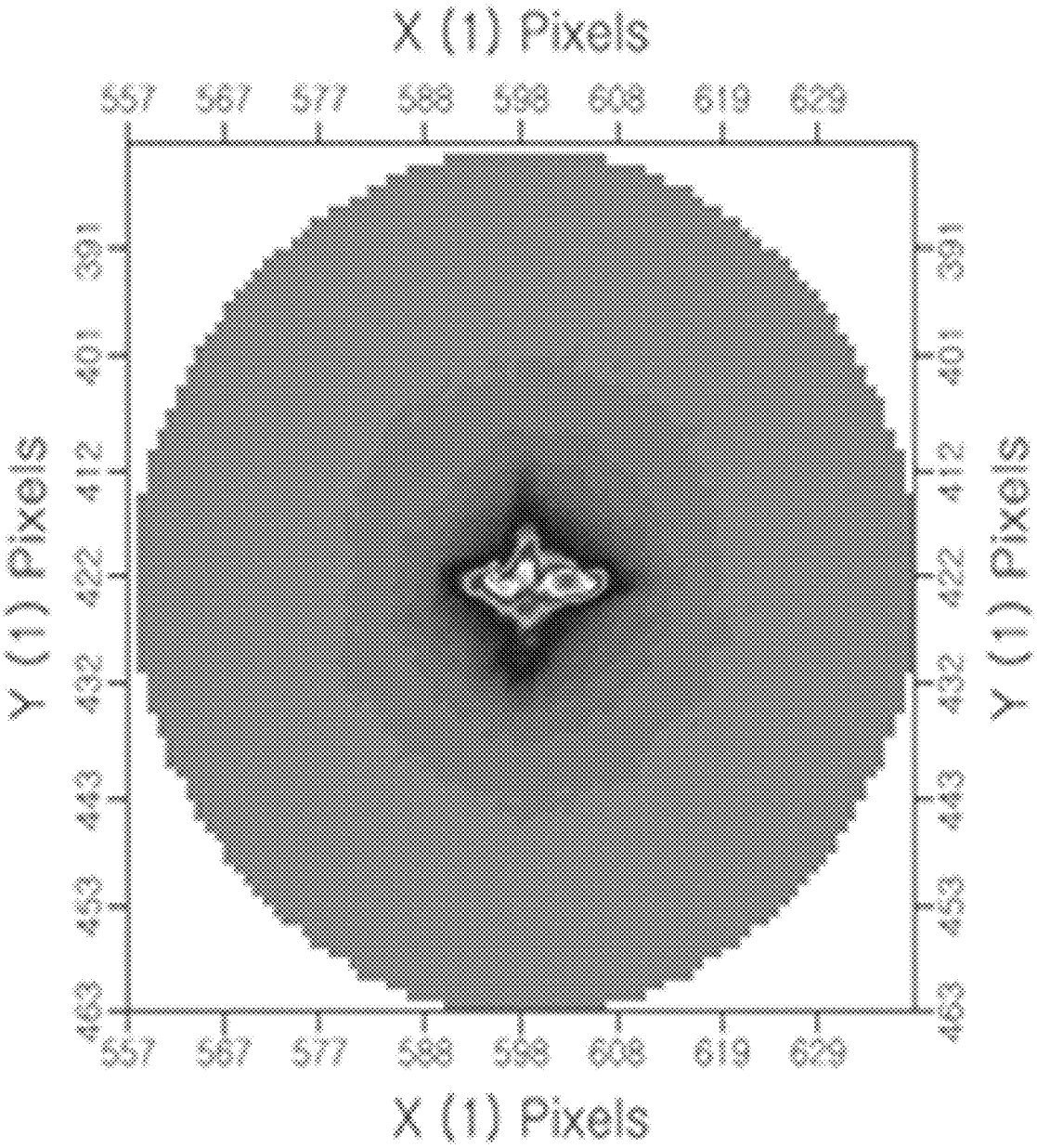
FIG. 6*a* is a graph showing a diameter of a light incident region of light which is incident on a phosphor plate.
Figure 6B:
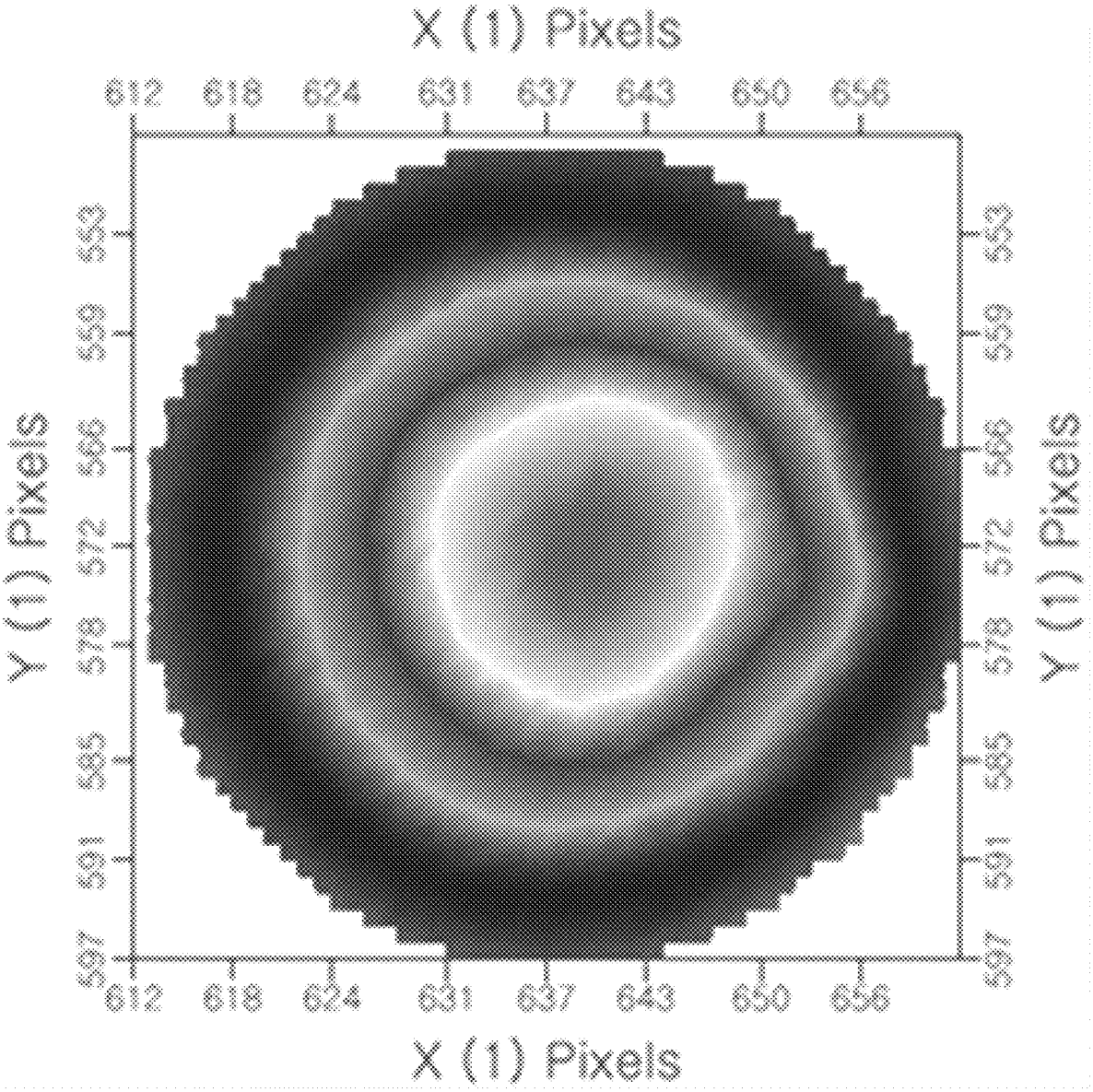
FIG. 6*b* is a graph showing a diameter of a light emitting region of a phosphor plate.

FIG. 6*a* is a graph showing the diameter of the light incident region of the light which is incident on the phosphor plate, and FIG. 6*b* is a graph showing the diameter of the light emitting region of the phosphor plate. FIG. 6*a* and FIG. 6*b* show diameters of the light incident region and the light emitting region of the phosphor plate 24 having a thickness of 60 μm to 80 μm.

As shown in FIG. 6*a*, the diameter of the light incident region of the phosphor plate is approximately 80 μm, and as shown in FIG. 6*b*, the diameter of the light emitting region of the phosphor plate is 320 μm, and hence the ratio of the diameter of the light incident region and the diameter of the light emitting region is approximately 1:4.

In general, in order to increase the size of the light emitting region which is emitted from the lighting device, it is necessary to increase the diameter of the light incident region, and accordingly it is necessary to increase the distance between the light source 10 and the phosphor plate 24. In other words, the lighting device becomes larger, i.e. it is difficult to miniaturize the structure of the lighting device. In contrast, for miniaturizing the lighting device, if the distance between the light source 10 and the phosphor plate 24 is decreased, the light incident region of the light which is incident on the phosphor plate 24 becomes too narrow. In this case, energy is concentrated on the phosphor plate 24, and the phosphor plate 24 may be damaged.

An embodiment according to the present invention is to prevent the above-mentioned issues, wherein due to the fact that the ratio of the diameter D1 of the light incident region and the diameter D2 of the light emitting region is different based on the thickness of the phosphor plate 24, the performance of the lighting device may be easily adjusted by controlling the light emitting region of the lighting device without limitations related to the distance between the phosphor plate 24 and the light source 10.

Referring to FIG. 1 again, a collimator 40 and a light concentrating unit 50 may be further disposed between the light source 10 and the light conversion unit 20. In this case, the collimator 40 is disposed closer to the light source 10 than the light concentrating unit 50.

The collimator 40 releases a laser ray which is output from the light source 10 as a parallel light ray, and the light concentrating unit 50 concentrates the parallel light ray which is released through the collimator 40. The light concentrating unit 40 may refract the laser ray which passes through the collimator 40 and then allow the refracted laser ray to be incident on the light conversion unit 20. The light concentrating unit 50 may consist of a condensing lens, and it may refract the laser light which is incident as a parallel light toward the center of the light conversion unit 20 and allow the laser light to be incident on the light conversion unit 20.

Hereinafter, a method of producing the phosphor plate according to embodiments of the present invention will be explained in detail in the following.

Figure 7:
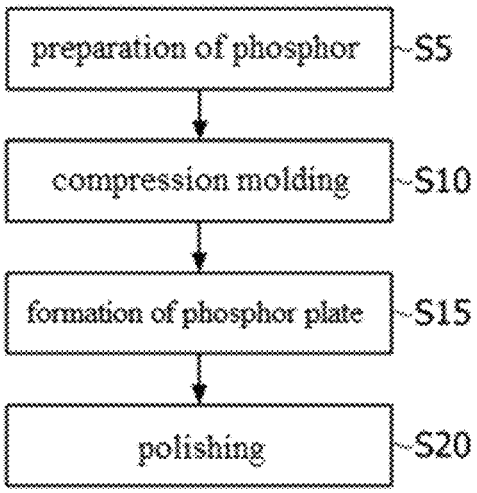
FIG. 7 is a block diagram of a method for producing a phosphor plate according to an embodiment of the present invention.

FIG. 7 is a block diagram of a method for producing a phosphor plate according to an embodiment of the present invention.

As shown in FIG. 7, a phosphor in a powder form is prepared S5. The phosphor may be one of yellow, green or red phosphors, and may be two or more types of phosphors that excite light which has different wavelengths, if necessary. For example, the phosphor may be any one type of phosphors selected from a group consisting of a ruthenium aluminium garnet (LuAG)-based, Yttrium Aluminium Garnet (YAG)-based, silicate-based, sulfide-based, and nitride-based phosphor, but the phosphor is not limited thereto.

Next, the phosphors, a binder, and the like are mixed, and compression molding is performed S10 by putting the mixture into a Stainless Use Steel (SUS) mold so as to have a plate or a discus shape. The binder may be selected from at least one type of compound selected from a group consisting of tetraethyl orthosillcate (TEOS), tetramethyl orthosillcate, tetrapropyl orthosilicate, and tetraisopropyl orthosilicate, but the binder is not limited thereto. The binder may also be mixed to enhance strength of the mixture.

The compression molding may be performed at 1 to 5 tons of pressure for 1 to 10 minutes. After the compression molding, cold isostatic pressing (CIP) may further be performed to make a high density molded product. CIP is a process in which a molded product is disposed in an elastic mold immersed in liquids such as water, and the molded product is subjected to have pressure applied from all directions by applying pressure to the liquids, and through the CIP process, the molded product can be pressured to be dense and uniform in shape.

A phosphor plate is formed S15 by performing vacuum firing by putting the compressed mixture into a firing furnace. In this case, a temperature and a time for performing the firing may be adjusted depending on a glass transition temperature of the phosphor. For example, the vacuum firing may be performed at a temperature of 1200° C. to 1800° C. and a pressure of $10^{-5}$ for 1 to 20 hours.

In order to adjust the thickness and surface roughness of the phosphor plate, a surface of the phosphor plate may be polished S20. In addition, in order to use the phosphor plate with an optical module such as a lighting device, a process such as dicing, drilling, and packaging may further be performed.

In particular, the phosphor plate 24 according to the present invention may further include a ceramic powder. The ceramic powder may prevent being subjected to physical and chemical effects to the phosphor contained in the phosphor plate 24, and allow the phosphor to be uniformly dispersed in the phosphor plate 24. The ceramic powder may be at least one type of silicate-based glass powder selected from a group consisting of sodium borosilicate, aluminosilicate, zinc borosilicate, and Barium sodium silicate, but the ceramic powder is not limited thereto.

The embodiments of the present invention as explained above are not limited to the accompanied embodiments and the drawings as described, and it will be apparent to those of ordinary skill in the art that it is possible to implement various substitutions, variations and modifications on the present invention without departing from the concept and scope of the present invention.

| DESCRIPTION OF REFERENCE NUMERAL | |
|---|---|
| 10: light source | 20: light conversion unit |
| 21: substrate | 22: antireflection coating |
| 23: short wavelength filter | 24: phosphor plate |
| 24a: first phosphor plate | 24b: second phosphor plate |
| 25: bonding layer | 30: housing |
| 30a: opening | 30b: inside surface |
| 40: collimator | 50: light concentrating unit |
| 100: molding | |

What is claimed is:

1. A phosphor plate, comprising:

a first surface comprising a light incident region on which light generated from a light source is incident, and towards which the light converges, the light incident region being an entire region on which the light is incident on the first surface; and a second surface opposite to the first surface and comprising a light emitting region that is an entire region from which the light is output on the second surface, wherein a wavelength of the incident light is converted by the phosphor plate, wherein a ratio of a diameter of the light incident region of the first surface of the phosphor plate and a diameter of the light emitting region of the second surface of the phosphor plate is 1:3 when a thickness of the phosphor plate, measured in a first direction perpendicular to the first surface, is 60 μm, and wherein a height of the first surface, measured in a second direction perpendicular to the first direction, is the same as a height of the second surface, measured in the second direction.

2. A lighting device, comprising:

a light source that generates a laser ray;

a light conversion unit comprising a substrate and a phosphor plate, the phosphor plate comprising a first surface and a second surface, the first surface comprising a light incident region on which the laser ray is incident and towards which the laser ray converges, the second surface comprising a light emitting region from a converted light excited by the laser ray is output, the light incident region being an entire region on which the light is incident on the first surface, and the light emitting region being an entire region from which the light is output on the second surface; and a housing disposed on the second surface of the light conversion unit and comprising an opening that exposes the light emitting region of the phosphor plate, wherein the substrate is disposed on the first surface of the phosphor plate, wherein the phosphor plate is disposed entirely between the substrate and the housing, in a first direction perpendicular to the first surface of the phosphor plate, and wherein a ratio of a diameter of the light incident region of the first surface of the phosphor plate and a diameter of the light emitting region of the second surface of the phosphor plate is 1:3 when a thickness of the phosphor plate, measured in a first direction perpendicular to the first surface, is 60 μm.

3. The lighting device of claim 2, wherein the housing covers a part of the second surface of the phosphor plate.

4. The lighting device of claim 2, wherein the housing comprises aluminum (Al), copper (Cu), or both.

5. The lighting device of claim 2, wherein a diameter of the opening of the housing increases as a distance from the light conversion unit increases.

6. The lighting device of claim 2, wherein the smallest diameter of the opening of the housing is the same as the diameter of the light emitting region.

7. The lighting device of claim 2, wherein the housing comprises an inner surface that is inclined so as to have a tilting angle θ of between 20° and 60° with respect to the second surface of the phosphor plate.

8. The lighting device of claim 2, wherein an angle of the converted light output from the light emitting region, with respect to the second surface, is between 150° and 170°.

9. The lighting device of claim 2, wherein the light conversion unit comprises:

a short wavelength filter disposed between a front surface of the substrate and the phosphor plate; and an antireflection coating disposed on a back surface of the substrate opposite from the front surface.

10. The lighting device of claim 9, wherein the antireflection coating is disposed to face the light source.

11. The lighting device of claim 9, wherein the light conversion unit comprises a molding that surrounds a side surface of the phosphor plate.

12. The lighting device of claim 11, wherein the molding is disposed between the housing and the short wavelength filter.

13. The lighting device of claim 9, comprising a bonding layer disposed between the phosphor plate and the short wavelength filter.

14. The lighting device of claim 2, comprising a collimator and a light concentrating unit disposed between the light source and the light conversion unit, wherein the collimator is disposed closer to the light source than it is to the light concentrating unit, and wherein the collimator is disposed closer to the light source than it is to the light concentrating unit.

15. The lighting device of claim 14, wherein the collimator releases as a parallel light ray the laser ray emitted from the light source.

16. The lighting device of claim 15, wherein the light concentrating unit concentrates the parallel light ray.

17. The lighting device of claim 16, wherein a thickness of the phosphor plate, measured in the first direction, is between 60 μm and 160 μm, wherein the housing covers a part of the second surface of the phosphor plate, wherein the housing comprises Al, Cu, or both, wherein a diameter of the opening of the housing increases as a distance from the light conversion unit increases, wherein the smallest diameter of the opening of the housing is the same as the diameter of the light emitting region, wherein the housing comprises an inner surface that is inclined so as to have a tilting angle θ of between 20° and 60° with respect to the second surface of the phosphor plate, wherein an angle of the converted light output from the light emitting region, with respect to the second surface, is between 150° and 170°, wherein the light conversion unit comprises:

a short wavelength filter disposed between a front surface of the substrate and the phosphor plate;

an antireflection coating disposed on a back surface of the substrate opposite from the front surface; and a molding that surrounds a side surface of the phosphor plate, wherein the antireflection coating is disposed to face the light source, wherein the molding is disposed between the housing and the short wavelength filter, and wherein the lighting device comprises a bonding layer disposed between the phosphor plate and the short wavelength filter.

18. The lighting device of claim 2, wherein a height of the first surface of the phosphor plate, measured in a second direction perpendicular to the first direction, is the same as a height of the second surface of the phosphor plate, measured in the second direction.

* * * * *